United States Patent [19]

McCarthy et al.

[11] 4,260,068

[45] Apr. 7, 1981

[54] STORAGE TANK AND FLOATING ROOF WITH A GAUGE WELL HAVING A FLOATING SEAL THEREIN

[75] Inventors: Robert R. McCarthy, East Brunswick; John J. Lipinski, Sewell, both of N.J.

[73] Assignee: Texaco Inc., White Plains, N.Y.

[21] Appl. No.: 111,131

[22] Filed: Jan. 10, 1980

[51] Int. Cl.[3] ..... B65D 88/42

[52] U.S. Cl. ..... 220/221

[58] Field of Search ..... 220/220, 221, 216, 219, 220/222, 223

[56] References Cited

U.S. PATENT DOCUMENTS

| | | | |
|---|---|---|---|
| Re. 29,270 | 6/1977 | Nelson | 220/220 |
| 2,237,461 | 4/1941 | Tokheim | 220/221 |

*Primary Examiner*—George T. Hall

*Attorney, Agent, or Firm*—Carl G. Ries; Robert A. Kulason; Henry C. Dearborn

[57] ABSTRACT

A floating vapor seal is suspended in a slotted gauge well that extends through a floating roof of a petroleum product storage tank. It has a flexible, product resistant layer that contacts the inside walls of the gauge well near the level of product in the well. The floating roof contacts the product around the gauge well and has a seal between it and the outside of the well.

5 Claims, 4 Drawing Figures

Fig.1.
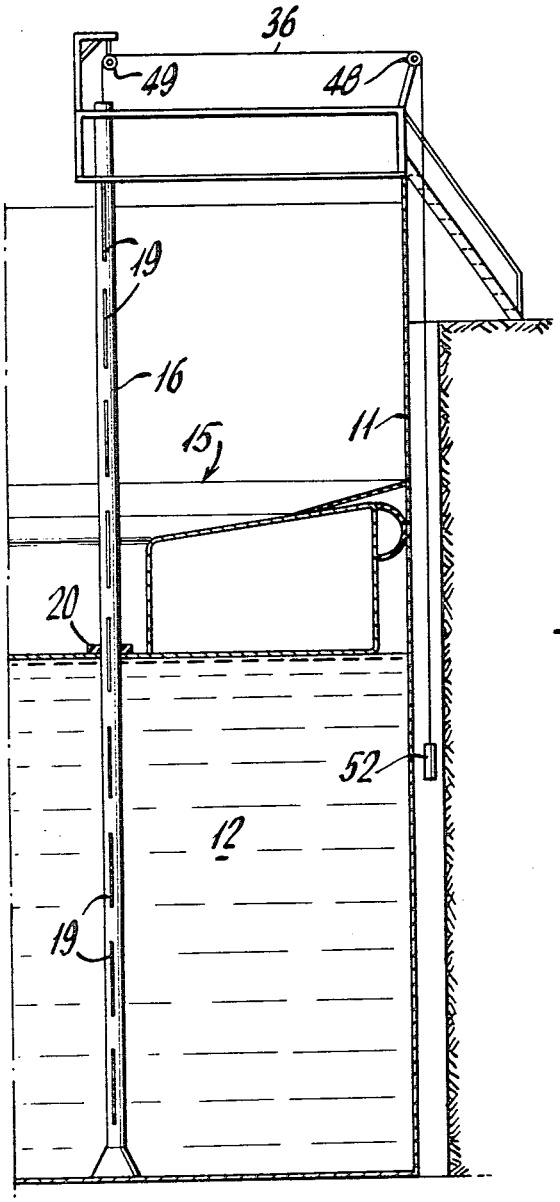
Fig.3.
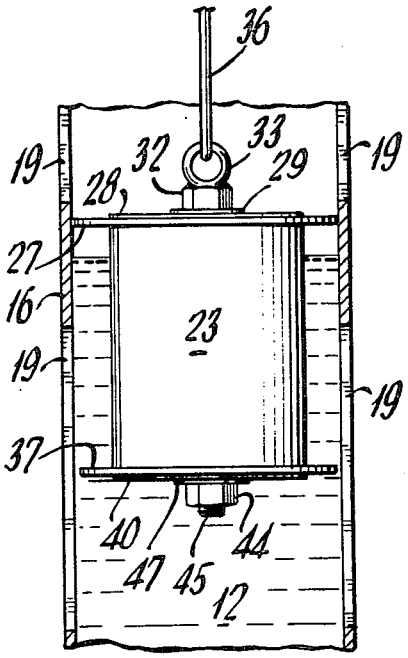
Fig.4.
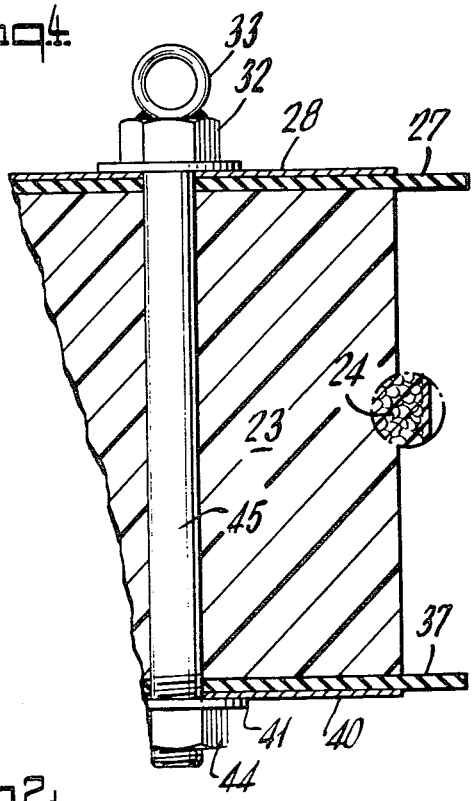
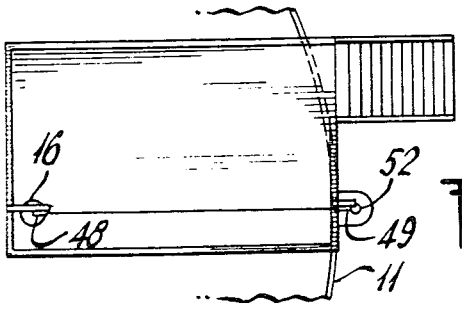
Fig.2.

STORAGE TANK AND FLOATING ROOF WITH A GAUGE WELL HAVING A FLOATING SEAL THEREIN

BACKGROUND OF THE INVENTION

1. Field of the Invention

This invention concerns vapor seals for storage tanks, in general. More specifically, it relates to a particular combination with a storage tank having a gauge well that is perforated and extends through a floating roof for the tank.

2. Description of the Prior Art

In connection with storage tanks or volatile products, the requirements for eliminating any vapor emissions have been found difficult where the tank has a floating roof and includes a perforated gauge well that extends through the roof with the perforations being applied to reduce venturi effects caused by air movements across the open top of such a well.

The lack of vapor seal caused by the foregoing indicated structure may be overcome by the use of a seal structure according to this invention. Thus, it is an object of this invention to provide for a floating seal arrangement that is applicable to a floating roof tank having a perforated gauge well therein. The floating seal will maintain a substantially vapor tight condition at the gauge well, so long as the seal remains in place during the periods between gauging activities.

SUMMARY OF THE INVENTION

Briefly, the invention is in combination with a storage tank for containing a volatile product and having a floating roof and including a guage well therein. The said well is attached to said tank and has perforations extending along the length thereof. The said floating roof rests on said product in the vicinity of the said gauge well and has a seal between it and the outside of said well. The said well extends above the maximum level of product, and there is a vapor seal to minimize vapor loss from said gauge well. The vapor seal comprises a body for floating on said product inside said well, and resilient seal means integral with said body for creating a vapor seal around the inside surface of said well.

Again briefly, the invention is in combination with a storage tank for containing a volatile product and having a floating roof and including a guage well therein. The said well is attached to said tank and has the bottom thereof always submerged and has perforations extending along the length thereof. The said floating roof rests on said product adjacent to said well and has a seal between it and the outside of said well. The said well extends above the maximum level of product. There is a vapor seal to minimize vapor loss from said gauge well which seal comprises a cylindrical body for floating on said product inside said well, and a first thin resilient sheet of material impervious to said vapor and resistant to said product and integrally attached to the upper surface of said cylindrical body for contacting the inside surface of said well. It also comprises a second thin sheet of material resistant to said product and integrally attached to the lower surface of said cylindrical body for guiding said body in a vertical position in said well, and a line attached to toe top of said body. It also comprises a pair of pulleys for attaching a counterweight to the other end of said line. All of the combination acts together, whereby said storage tank remains substantially vapor sealed continuously, except during manual product gauging.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein:

FIG. 1 is a fragmentary schematic showing a cross-section of a floating roof type tank with a gauging well therein;

FIG. 2 is a plan view of the elements illustrated in FIG. 1;

FIG. 3 is an enlarged longitudinal cross-section of a fragmentary portion of the gauging well illustrated in FIGS. 1 and 2 with a floating seal according to the invention therein; and FIG. 4 is an additionally enlarged fragmentary elevation partly in cross-section, illustrating the elements of the seal float structure according to the invention.

DESCRIPTION OF THE PREFERRED EMBODIMENT

As indicated above, the invention particularly concerns a storage tank of the type which includes a floating roof and also has a gauging well as part of the storage tank structure. Such gauging well is one that has perforations extending along the length thereof which are employed in order to reduce venturi effects that are caused by air movements across the open top of such gauging well. Such a storage tank structural combination has a difficulty in connection with meeting air pollution regulations, in that the gauging well is open so that it emits vapors. Whereas, the regulations require that such a tank be vapor tight except during manual gauging procedures. This invention provides for a total combination which can provide the necessary seal to maintain vapor seal conditions in accordance with regulations, such that only during manual gauging would any substantial vapors be permitted to escape through a gauging well.

Referring to the drawings, it will be observed that there is a storage tank 11 that holds a quantity of volatile product 12 therein. There is a floating roof 15 which rests on the product 12 and which is in contact with the product 12 adjacent to a gauging well 16. Gauging well 16 is firmly attached to the storage tank 11 at the bottom, and it has a plurality of perforation slots 19. The slots are spaced apart along the length of the gauging well 16.

There is a vapor tight seal 20 that is mounted on the roof 15 at the lower surface thereof which rests on the product 12. The seal 20 surrounds the outside of the gauging well 16, and of course the seal moves with the roof 15 as the level of the product changes.

In order to provide a vapor seal for the inside of the gauging well 6 which inside seal will act at all times except when a gauging operation is taking place, there is a vapor seal structure which is illustrated in detail in FIGS. 3 and 4. Such vapor seal is constructed so that it will float on the surface of the product inside of the gauging well 16. It is made up of a cylindrical body 23 that is preferably constructed of a closed cell polyethylene foam 24, as indicated in the magnified enlargement on the side of the body 23 in FIG. 4.

At the top of the body 23 there is a thin resilient sheet of neoprene material 27 which is sized to contact the inside surfaces of the gauging well 16 for maintaining a vapor seal therewith. This sheet 27 is, of course, resilient and is attached at the upper surface of the cylindrical body 23 by means of any feasible arrangement, such as by having a thin disc 28 and a washer 29 under a bolt head 32 which has a ring 33 welded thereon for attaching a support line 36. The line 36 is used in order to support a portion of the weight of the vapor seal structure.

At the bottom of the body 23, there is another thin sheet 37 which may be made of neoprene also, but which acts as a guide to maintain the body 23 in an upright position within the gauging well 16. Consequently, the sheet 37 has a smaller diameter than the inside diameter of the gauging well 16. This provides adequate clearance for permitting product to flow around the sheet 37, and at the same time provide adequate guiding for the floating seal structure as it moves vertically within the gauging well. The sheet 37 is held in place by a disc 40 and a washer 41 that goes under a nut 44 which threads onto the lower end of a bolt 45.

In order to have the line 36 support a substantial portion of the weight of the floating seal structure, there are a pair of pulleys 48 and 49 that are mounted in the manner indicated in FIGS. 1 and 2, so as to maintain a counterweight 52 acting to balance the required amount of the weight of the floating seal. Such counter weighting is done in order that the whole floating seal will be maintained with the seal sheet 27 just above the surface of the product 12 on the inside of the gauging well 16.

It will be appreciated that this combination of elements acts in relationship to a floating roof type storage tank that has a perforated gauging well extending through the roof. Consequently, the vapor seal which would otherwise be lost because of such gauging well element, may be maintained with a high degree of efficiency. Of course, during a manual gauging operation, the floating seal unit will be removed by lifting it by means of the line 36. Thus, it may be removed out of the gauging well 16 during a manual gauging operation.

While a particular embodiment of the invention has been described above in considerable detail in accordance with the applicable statutes, this is not to be taken as in any way limiting the invention but merely as being descriptive thereof.

We claim:

1. In combination with a storage tank for containing a volatile product and having a floating roof and including a gauge well therein, said well being attached to said tank and having perforations extending along the length thereof, said floating roof resting on said product in the vicinity of said well and having a seal between it and the outside of said well, said well extending above the maximum level of product, a vapor seal to minimize vapor loss from said gauge well, comprising a body for floating on said product inside said well, resilient seal means integral with said body for creating a vapor seal around the inside surface of said well.

2. The invention according to claim 1, wherein said vapor seal also comprises guide means spaced vertically from said resilient seal means for maintaining said body vertical in said well.

3. The invention according to claim 2, wherein said vapor seal also comprises means for suspending said body for removal from said well when said product level is to be gauged.

4. The invention according to claim 3, wherein said suspending means comprises a line and pulley means for counterweighting said body.

5. In combination with a storage tank for containing a volatile product and having a floating roof and including a gauge well therein, said well being attached to said tank and having the bottom thereof always submerged and having perforations extending along the length thereof, said floating roof resting on said product adjacent to said well and having a seal between it and the outside of said well, said well extending above the maximum level of product, a vapor seal to minimise vapor loss from said gauge well, comprising a cylindrical body for floating on said product inside said well, a first thin resilient sheet of material impervious to said vapor and resistant to said product and integrally attached to the upper surface of said cylindrical body for contacting the inside surface of said well, a second thin sheet of material resistant to said product and integrally attached to the lower surface of said cylindrical body for guiding said body in a vertical position in said well, A line attached to the top of said body, and a pair of pulleys for attaching a counterweight to the other end of said line, all whereby said storage tank remains substantially vapor sealed continuously except during manual product gauging.

* * * * *